United States Patent [19]

Sosnowski

[11] 4,229,283

[45] Oct. 21, 1980

[54] FLUID HYDROCOKING WITH THE ADDITION OF DISPERSIBLE METAL COMPOUNDS

[75] Inventor: John Sosnowski, Westfield, N.J.

[73] Assignee: Exxon Research & Engineering Co., Florham Park, N.J.

[21] Appl. No.: 959,208

[22] Filed: Nov. 9, 1978

[51] Int. Cl.[2] ..... C10G 13/18

[52] U.S. Cl. ..... 208/127; 48/197 R; 208/10; 208/108

[58] Field of Search ..... 208/108, 127, 9, 10, 208/107, 8 R

[56] References Cited

U.S. PATENT DOCUMENTS

| | | | |
|---|---|---|---|
| 1,876,270 | 9/1932 | Zorn et al. | 208/108 |
| 2,091,831 | 8/1937 | Pongratz et al. | 208/108 |
| 2,885,350 | 5/1959 | Brown et al. | 208/127 |
| 2,888,393 | 5/1959 | Ballard et al. | 208/58 |
| 2,888,395 | 5/1959 | Henny | 208/111 |
| 3,131,142 | 4/1964 | Mills | 208/108 |
| 4,051,016 | 9/1977 | Metrailer | 208/127 |
| 4,057,487 | 11/1977 | Metrailer et al. | 208/127 |
| 4,169,041 | 9/1979 | Schuette | 208/108 |

*Primary Examiner*—Herbert Levine

*Attorney, Agent, or Firm*—Marthe L. Gibbons

[57] ABSTRACT

A high pressure fluid hydrocoking process is provided in which certain metal compounds which act as coke forming inhibitors are dispersed in the coker chargestock. Preferred compounds are molybdenum compounds, for example, molybdenum naphthenate. The hydrogen-containing fluidizing gas may also comprise hydrogen sulfide.

1 Claim, 1 Drawing Figure

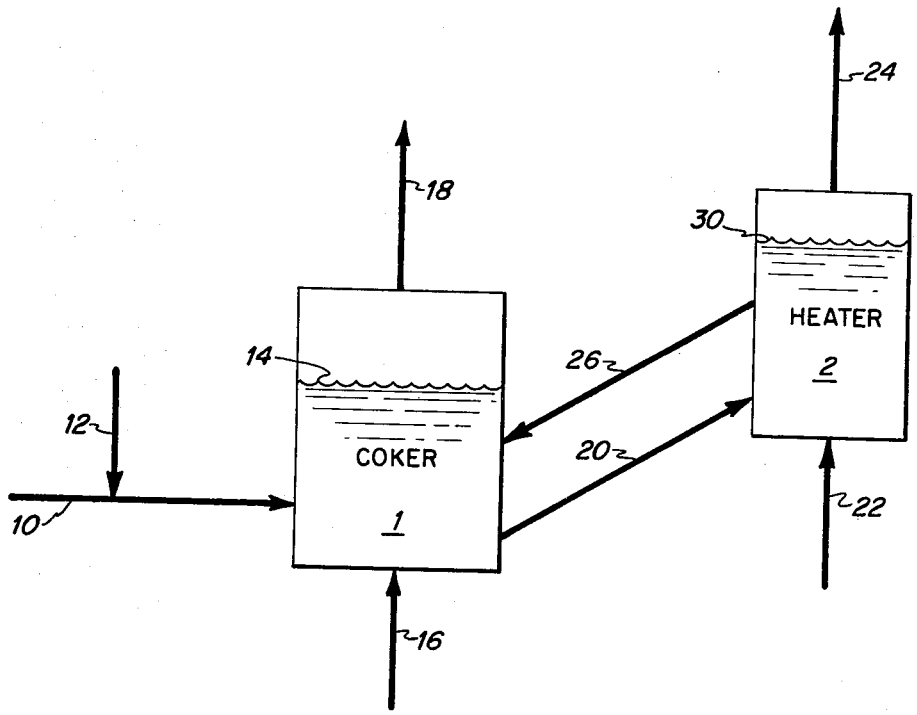
24
18
30
HEATER
2
14
26
12
COKER
1
20
10
22
16

FLUID HYDROCOKING WITH THE ADDITION OF DISPERSIBLE METAL COMPOUNDS

BACKGROUND OF THE INVENTION

1. Field of the Invention

This invention relates to an improvement in a fluid hydrocoking process. More particularly, this invention relates to a fluid hydrocoking process in which certain metal compounds are added to the chargestock.

2. Description of the Prior Art

Fluid coking is a well known process which may be carried out with or without recycle of the heavier portion of the fluid coking zone effluent. As is well known in the art, the fluid coking process, as shown, for example, in U.S. Pat. No. 2,881,130, which is hereby incorporated by reference, uses a fluid coking vessel and an external heating vessel. A fluid bed of solids, preferably coke particles produced by the process having a size in the range from about 40 to about 1000 microns is maintained in the coking zone by the upward passage of a fluidizing gas, usually steam, injected at a superficial velocity usually between 0.5 and 5 feet per second. The temperature of the fluid coking bed is maintained in the range of from about 850° to about 1400° F., preferably between 950° and 1100° F. by circulating solids (coke) to the heating vessel and back. The heavy oil to be converted is injected into the fluid bed and upon contact with the hot solids undergoes pyrolysis evolving lighter hydrocarbon products in vapor phase, including normally liquid hydrocarbons, and depositing a carbonaceous residue (coke) on the solids. The turbulence of the fluid bed normally results in substantially isothermal reaction conditions and thorough and rapid distribution of the heavy injected oil. Product vapors, after removal of entrained solids, are withdrawn overhead from the coking zone and sent to a scrubber and fractionator for cooling and separation. The end boiling point of distillate fraction obtained from the process is usually 1050° to about 1200° F. and the remaining heavy ends are usually recycled to extinction.

It is known to add hydrogen to a fluid coking zone (hydrocoking); see, for example, U.S. Pat. Nos. 2,888,395 and 2,888,393. High pressure by hydrocoking is known; see, for example, U.S. Pat. No. 2,885,350. The addition of hydrogen sulfide to the treat gas of a fluid coker including the addition of hydrogen sulfide to a hydrogen-containing treat gas is known; see, for example, U.S. Pat. No. 4,051,016. It is also known to use oil soluble organometallic compounds in thermal cracking or in destructive hydrogenation of hydrocarbons; see, for example, U.S. Pat. No. 1,876,270.

It is also known to conduct cracking or destructive hydrogenation in the presence of oil soluble salts of acid organic compounds selected from the group consisting of carboxylic acids and phenol with a metal of Group IV and Group VIII of the Periodic Table; see, for example, U.S. Pat. No. 2,091,831.

A slurry hydrocracking process is also known in which an oil soluble compound of Groups IV to VIII is added to a heavy oil feed; see, for example, U.S. Pat. No. 3,131,142.

It has now been found that the addition of a minor amount of certain metal compounds which act as coke forming inhibitors to the chargestock of a fluid hydrocoking process operated at elevated pressures will provide advantages that will become apparent in the ensuing description.

SUMMARY OF THE INVENTION

In accordance with the invention there is provided, a fluid coking process which comprises the steps of: (a) adding to a carbonaceous chargestock having Conradson carbon content of at least 5 weight percent, a metal compound selected from the group consisting of metal salts of organic acids, metal phenolates, metal halides, inorganic poly acids and mixtures thereof wherein the metal constituent of said metal compound is selected from the group consisting of Groups IVB, VB, VIB, VIIB and VIII of the Periodic Table of Elements and mixtures thereof, and (b) contacting the resulting mixture with hot fluidized solids in a fluidized coking bed contained in a coking zone maintained in a fluidized state by the introduction of a hydrogen-containing fluidizing gas, said coking zone being maintained at a temperature ranging from about 750° F. to about 1100° F. and at a total pressure ranging from about 400 to about 3000 psig to produce a vapor phase product and a solid carbonaceous material which deposits on said fluidized solids.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a carbonaceous material having a Conradson carbon content of at least 5 weight percent is passed by line 10 into a coking zone 1 in which is maintained a fluidized bed of solids (e.g. coke particles of 40 to 1000 microns in size) having an upper level indicated at 14. Suitable carbonaceous chargestocks for the present invention include heavy hydrocarbonaceous oils, heavy and reduced petroleum crudes, atmospheric residuum, pitch, asphalt, bitumen, other heavy hydrocarbon residues, coal, slurries of coal and oil, slurries of coal and water, liquid products derived from coal liquefaction process, including coal liquefaction bottoms, and mixtures thereof. Typically such carbonaceous chargestocks have a Conradson carbon content of at least 5 weight percent, generally from about 5 to about 50 weight percent, preferably above 7 weight percent (as to Conradson carbon residue, see ASTM test D-189-65). A metal compound is added to the carbonaceous chargestock by line 12. Preferably, the metal compound is an oil soluble compound or an oil dispersible compound. Suitable metal compounds to be added to the chargestock of the present invention include metal salts of organic acids, such as acyclic and alicyclic aliphatic carboxylic acids containing two or more carbon atoms, e.g. naphthenic acids; metal phenolates; metal halides; inorganic poly acids, such as isopoly acids and heteropoly acids (e.g. phosphomolybdic acid) and mixtures thereof wherein the metal constituent is selected from the group consisting of Groups IVB, VB, VIB, VIIB and VIII of the Periodic Table of Elements, in accordance with the table published by E. H. Sargent and Co., copyright 1962, Dyna Slide Company. The terms "isopoly acids" and "heteropoly acids" are used herein in accordance with the definition given in *Advanced Inorganic Chemistry,* 3rd edition, by F. A. Cotton and Geoffrey Wilkinson, Interscience Publishers, N.Y., pages 950 to 957. The preferred metal constituent of the added metal compound is selected from the group consisting of molybdenum, vanadium and chromium. The more preferred metal compound is a molybdenum compound. The preferred metal compounds are molybdenum naphthenate and phosphomolybdic acid. The added metal compound is dissolved or dispersed in the carbonaceous chargestock. When coal is used as the feed, the coal particles may be slurried in the hydrocarbonaceous oil to which the metal compound is added.

The metal compound is added to the carbonaceous chargestock in an amount ranging from about 10 to about 950 wppm, preferably about 50 to about 500 wppm, more preferably from about 50 to about 200 wppm, said weight being calculated as if the compound existed as the elemental metal, based on the initial carbonaceous chargestock.

A fluidizing gas is admitted into the coking reactor 1 by line 16 in an amount at least sufficient to maintain the superficial gas velocity in the range of about 0.5 to about 5 feet per second. The fluidizing gas introduced into the coking reactor comprises at least 40 mole percent hydrogen, preferably from about 60 to about 90 mole percent hydrogen and may also comprise steam, gaseous hydrocarbons, vaporized normally liquid hydrocarbons, and hydrogen sulfide. Preferably, the hydrogen-containing fluidizing gas also comprises hydrogen sulfide in an amount ranging from about 2 to about 30 mole percent, preferably from about 5 to about 15 mole percent.

Coke at a temperature above the coking temperature, for example, at a temperature 100 to 800 Fahrenheit degrees in excess of the actual operating temperature of the coking zone is admitted to coker 1 by line 26 in an amount sufficient to maintain the coking zone at a temperature in the range of about 750 to about 1100° F., preferably in the range of about 800 to about 950° F. The total pressure in the coking zone is maintained in the range of about 400 to about 3000 pounds per square inch gauge (psig), preferably in the range of about 400 to about 1500 psig. The lower portion of the coking reactor serves as a stripping zone to remove occluded hydrocarbons from the solids. A stream of solids is withdrawn from the stripping zone by line 20 and circulated to heater 2. The vaporous product includes gaseous hydrocarbons and normally liquid hydrocarbons as well as other gases which were introduced into the coking reactor as fluidizing gas. The vapor phase product is removed from coker 1 by line 18 for scrubbing and fractionation in a conventional way. If desired, at least a portion of the vaporous effluent may be recycled to the coker as fluidizing gas. A stream of heavy material condensed from the vaporous coker effluent may be recycled to the coker or the coker may be operated in a once-through manner, that is, without recycle of the heavy materials in the coker.

A stream of stripped coke (commonly called cold coke) is withdrawn from the coker by line 20 and introduced to a fluid bed of hot coke having a level 30 in heater 2. The heater can be operated as a conventional coke burner such as disclosed in U.S. Pat. No. 2,881,130, which is hereby incorporated by reference. When the heater is operated as a burner, an oxygen-containing gas, typically air, is introduced into heater 2 by line 22. The combustion of a portion of the solid carbonaceous deposition on the solids with the oxygen-containing gas provides the heat required to heat the colder particles. The temperature in the heating zone (burning zone) is maintained in the range of about 1200 to about 1700° F. Alternatively, heater 2 can be operated as a heat exchange zone such as disclosed in U.S. Pat. Nos. 3,661,543, 3,702,516 and 3,759,676, the teachings of which are hereby incorporated by reference. Hot coke is removed from the fluidized bed in heater 2 and recycled to the coking reactor by line 26 to supply the heat thereto. As another alternative, heater 2 can be operated as a gasification zone wherein the stream of solids withdrawn from the coker by line 20 and passed to heater 2 is contacted with steam and a molecular oxygen-containing gas such as air, oxygen or air enriched with oxygen at a temperature ranging from about 1600 to about 2000° F. and at approximately the same pressure as the pressure maintained in the coker to produce a gaseous fuel and a solid residue which comprises predominantly metallic ashes. A portion of the metallic ashes or the overhead fines of these metallic ashes comprising primarily nickel and vanadium oxides as well as the metal of the metal compound initially introduced into the chargestock, may be recycled to the chargestock of the coker to act as coke forming inhibitors. The addition of metal compounds selected from the group of salts of organic acids, phenolates, halides and heteropoly acids may be discontinued when the metallic ashes are recycled to the chargestock. Optionally, solids withdrawn from the coker may be recycled to the chargestock of the coker to minimize or eliminate the amount of fresh metal compound to be added to the chargestock. An advantage of the process of the invention over conventional slurry processes is the ease of separation of the solids from the liquid products.

While the process has been described for simplicity of description with respect to circulating coke as the fluidized solids, it is to be understood that the fluidized seed particles on which the coke is deposited in the coker may be silica, alumina, zirconia, magnesia, calcium oxide, alundum mullite, bauxite or the like.

What is claimed is:

1. A fluid coking process which comprises the steps of:

(a) adding to a carbonaceous chargestock having a Conradson carbon content of at least 5 weight percent, a metal compound selected from the group consisting of metal salts of organic acids, metal phenolates, metal halides, inorganic poly acids and mixtures thereof wherein the metal constituent of said metal compound is selected from the group consisting of Groups IVB, VB, VIB, VIIB and VIII of the Periodic Table of Elements and mixtures thereof, (b) contacting the resulting mixture with hot fluidized solids in a fluidized coking bed contained in a coking zone maintained in fluidized state by the introduction of a hydrogen-containing fluidizing gas, said coking zone being maintained at a temperature ranging from about 750° F. to about 1100° F. and at a total pressure ranging from about 400 to about 3000 psig to produce a vapor phase product and a solid carbonaceous material which deposits on said fluidized solids, (c) withdrawing a portion of said solids from said coking zone, and contacting at least a portion of said withdrawn solids with steam and a molecular oxygen-containing gas at a temperature ranging from about 1600° F. to about 2000° F. to produce a fuel gas and metallic ashes, (d) recycling at least a portion of said metallic ashes to said chargestock, and (e) discontinuing the addition of said metal compound of step (a).

* * * * *